US009845135B2

(12) United States Patent
Handley

(10) Patent No.: US 9,845,135 B2
(45) Date of Patent: Dec. 19, 2017

(54) EXTENDABLE HULL SYSTEM MOVABLE BETWEEN MONO-HULL AND MULTI-HULL CONFIGURATIONS

(71) Applicant: Ian Matthew Handley, Myrtle Beach, SC (US)

(72) Inventor: Ian Matthew Handley, Myrtle Beach, SC (US)

( * ) Notice: Subject to any disclaimer, the term of this patent is extended or adjusted under 35 U.S.C. 154(b) by 34 days.

(21) Appl. No.: 15/009,522

(22) Filed: Jan. 28, 2016

(65) Prior Publication Data

US 2017/0217543 A1 Aug. 3, 2017

(51) Int. Cl.

| | |
|---|---|
| ***B63B 1/00*** | (2006.01) |
| ***B63B 1/20*** | (2006.01) |
| ***B63B 1/22*** | (2006.01) |
| ***B63B 17/02*** | (2006.01) |
| ***B63B 29/04*** | (2006.01) |
| *B63B 1/14* | (2006.01) |

(52) U.S. Cl.

CPC ..... *B63B 1/20* (2013.01); *B63B 1/22* (2013.01); *B63B 17/02* (2013.01); *B63B 29/04* (2013.01); *B63B 2001/145* (2013.01); *B63B 2001/209* (2013.01)

(58) Field of Classification Search

CPC .. B63B 1/20; B63B 1/22; B63B 29/04; B63B 17/02

USPC ..... 114/61.18, 361

See application file for complete search history.

(56) References Cited

U.S. PATENT DOCUMENTS

| | | | | |
|---|---|---|---|---|
| 5,829,376 | A * | 11/1998 | Kostanski | B63B 1/125 114/123 |
| 6,298,802 | B1 * | 10/2001 | Brignolio | B63B 7/02 114/344 |
| 8,028,641 | B1 * | 10/2011 | Sly | B63B 27/146 114/362 |
| 2009/0178605 | A1 * | 7/2009 | Tufte | B63B 17/02 114/361 |
| 2014/0299029 | A1 * | 10/2014 | Handley | B63B 7/02 114/61.18 |

OTHER PUBLICATIONS

High-tech watercraft transforms from monohull, to catamaran, to trimaran, to hydrofoil. (n.d.). Retrieved Jan. 20, 2016, from http://www.gizmag.com/high-tech-transforming-kormaran-watercraft/33875/.

* cited by examiner

*Primary Examiner* — Stephen P Avila
(74) *Attorney, Agent, or Firm* — Dunlap Bennett & Ludwig PLLC

(57) ABSTRACT

An extendable hull system movable between a mono-hull to a multi-hull configuration is provided so as to take advantage of both types of hull designs depending on the boating conditions. The extendable hull system provides a center hull portion and two side hull portions, each with separate planing surfaces in an expanded multi-hull configuration, and providing a shared planing surface in the contracted mono-hull configuration. The extendable hull system provides a pivotably connected railing system along a periphery of the side hull portions for moving to a deployed configuration providing additional walking surface. The extendable hull system provides a retractable awning movable between positions for covering the mono-hull and the multi-hull configuration.

10 Claims, 8 Drawing Sheets

EXTENDABLE HULL SYSTEM MOVABLE BETWEEN MONO-HULL AND MULTI-HULL CONFIGURATIONS

BACKGROUND OF THE INVENTION

The present invention relates to expandable watercraft and, more particularly, to a watercraft system expandable from a mono-hull to a multi-hull and able to be contracted back to the mono-hull so as to take advantage of both types of hull designs depending on the boating conditions.

A boat floats because it displaces a greater weight of water than its own weight. When a boat is sitting still or moving slowly, the hull is "in displacement mode." That is, all of the upward forces keeping it on top of the water come from flotation obtained by displacing water. Increase the boat's speed beyond a certain point with certain hulls and the hull rises up and skims along on top of the water. This is called "planing." As a result, generally speaking, a hull can be described as a displacement hull or a planing hull.

The displacement hull is typically restricted to relatively slow speeds but is extremely efficient to run. In comparison, the planing hull is designed to achieve high speeds on the water by transitioning onto a plane easily. Planing hulls may include flat bottom surfaces from amidships aft (from the middle to the back of the bottom) and a flat transom (back of the hull). The transom may meet the bottom at a sharp angle.

Boats come in two broad categories: mono-hull (or single hull) and multi-hull. Mono-hull boats typically have a flat transom stern and a pointed bow for facilitating planing. Multi-hull boats have two or more hulls joined by a bridge deck or other structure. Multi-hull boats provide a good rough-water ride as they can take on big waves with a stable platform. Also, wider boats feel more stable, which makes them popular for dockside entertaining or angling. Multi-hull boats suffer, however, from the disadvantage of being too wide for conventional marina docks and convenient transport over land.

Narrower, mono-hull boats more readily offer the planing hull, the need for speed, and the need to operate in tight quarters. Plus, it can take more fuel to move a wide boat at a given speed than a narrow hull of similar length. Single narrow hulls, however, have trouble handling heavy weather and cannot take on big waves at high speeds, but must reduce to displacement mode. In fact, if the boating conditions are sufficiently adverse, skippers of such narrow, mono-hull boats are advised to forget their intended destination and bring the bow around into the wind and waves using just enough power to make bare steerage.

As can be seen, there is a need for a watercraft system extendable from a mono-hull to a multi-hull and able to be contracted back to the mono-hull so as to take advantage of both types of hull designs depending on the boating conditions.

An extendable hull system movable between mono-hull and multi-hull offers advantages, yet, also presents challenges. For example, conventional watercraft weather screens (for sun and rain protection) do not contemplate being employed on expandable watercraft, and as a result their framework is rigid and non-adjustable; moreover, such weather screens would not provide efficient coverage for expandable watercraft, as they would not be able to adjustably expand along with such watercraft.

Therefore there is a need for a weather screen assembly that can remotely expand to cover the entire length of an expanded watercraft as well as provide efficient coverage when the expandable watercraft is in a contracted configuration. Moreover, the weather screen assembly could advantageously expand out and hang over the edge of each side of any watercraft to provide for the roll off of rain without getting in the watercraft. Also, screens can be attached to the weather screen assembly to keep bugs outside the boat, and video and audio output device could be removably affixed to the weather screen assembly.

Furthermore, expandable watercraft may suggest the need to further expand the walking space beyond its expanded configuration because of the stability on the water it affords. Therefore there is a need for further expanding the walking space by providing a railing system that may be movable from a locked configuration to a deployed configuration, providing an additional walking surface generally flush with the expandable decking in the expanded or contracted configuration. In the locked configuration, the railing system may be locked generally perpendicular to the decking so as to provide protection to crew and deck furniture from going overboard.

As can also be seen, there is a need for an expandable watercraft system to provide solutions to the challenges presented by being movable between multi-hull and mono-hull configurations.

SUMMARY OF THE INVENTION

In one aspect of the present invention, an extendable hull system adapted to move between a mono-hull contracted configuration and a multi-hull configuration includes a center hull portion connected to a plurality of fixed frame elements; two side hull portions, one of the two side hull portions disposed on the port and the starboard side of the center hull portion, respectively, wherein each side hull portion is connected to a plurality of slidable elements, each slidable element received by an associated complement fixed frame element of the plurality of fixed frame elements; and a plurality of actuator arms, each actuator arm extending from a fixed end to an extendable end, wherein each fixed end is connected to the plurality of fixed frame elements, and wherein each extendable end is connected to one of the two side hull portions so as to provide a mono-hull contracted configuration.

In another aspect of the present invention, the extendable hull system further includes a retractable awning dimensioned and adapted to selectively move between a contracted position and an expanded position, wherein the expanded position provides coverage in the expanded configuration.

In yet another aspect of the present invention, the extendable hull system further includes a railing system pivotably connected to at least one of the two side hull portions so as to be movable between a vertical configuration orthogonal to the plurality of slidable elements and a deployed configuration parallel and adjacent to the plurality of slidable elements associated with the at least one of the two side hull portions.

These and other features, aspects and advantages of the present invention will become better understood with reference to the following drawings, description and claims.

DETAILED DESCRIPTION OF THE INVENTION

Figure 1:
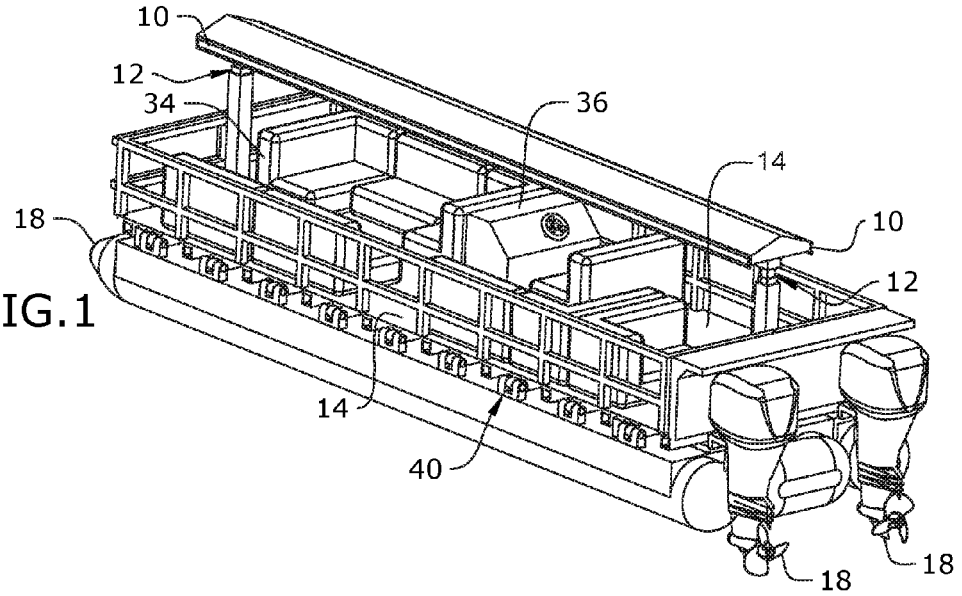
FIG. 1 is a perspective view of an exemplary embodiment of the present invention, illustrating a contracted configuration.
Figure 2:
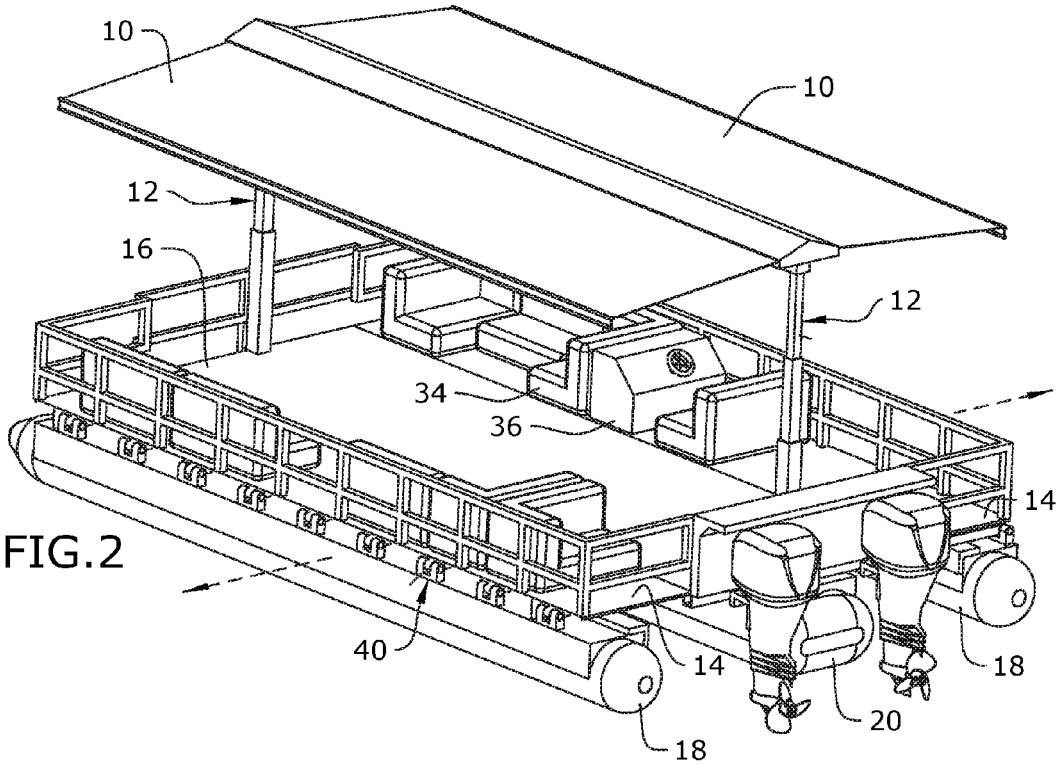
FIG. 2 is an exploded view of an exemplary embodiment of the present invention, illustrating a contracted configuration.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an extendable hull system movable between a mono-hull to a multi-hull configuration so as to take advantage of both types of hull designs depending on the boating conditions. The extendable hull system provides a center hull portion and two side hull portions, each with separate planing surfaces in an expanded multi-hull configuration, and providing a shared planing surface in the contracted mono-hull configuration. The extendable hull system provides a pivotably connected railing system along a periphery of the side hull portions for moving to a deployed configuration providing additional walking surface. The extendable hull system provides a retractable awning movable between positions for covering the mono-hull and the multi-hull configuration.

The width of boat hulls is typically constrained by the limitations of slip-docking, storage, trailer preparation and other transportation considerations, while currently expandable or extendable boats are limited in deck width because of the rigid attachment between the expandable hull portions and the adjustable frame carrying the deck. Instructively, hull strength is a function of frame width. Therefore, there is a need for extendable boat hulls movable between a contracted configuration for storage and transportation and an expanded configuration once afloat, ergo an extendable hull system.

The extendable hull system may include a center hull portion, two side hull portions, an adjustable frame and a plurality of actuator arms. The adjustable frame may include a plurality of fixed frame elements and a plurality of slidable elements. The plurality of fixed frame elements may be supported in a traverse relationship to and along the length of the center pontoon. Each elongated slidable element may have a received end and a hinged end. Each fixed frame element may be tubular having two opposing ends, wherein each opposing end may be adapted to slidably receive one received end. The plurality of hinged ends may be pivotably connected to either one of the two side hull portions. Each actuator arm may have a fixed end and an extendable end, wherein the plurality of fixed ends are connected to one fixed frame element, and wherein the plurality of extendable ends are connected to the two side hull portions so that the two side hull portions are extendable relative to the center hull portion by shifting the two side hull portions between a contracted position and an expanded position.

Referring to FIGS. 1 through 7, the present invention may include an extendable hull system 100. The extendable hull system 100 may include a fixed deck 16, two mobile decks 14, a center hull portions 20, 148, two side hull portions 18, 144, an adjustable frame 44 and a bracing system 46.

The hull portions 18, 144, 20, 148 may be any hull shape that provides buoyancy to the associated boat. The two side hull portions 18, 144 may have an above-water surface including a padded edge 66 and a hinge edge 68. The padded edge 66 may have a plurality of pads 42 attached along at least a portion of the length of each side hull portion 18.

The adjustable frame 44 may include a plurality of elongated fixed elements 22, a plurality of elongated slidable elements 24 and a plurality of actuator arms 26. The plurality of fixed elements 22 and the plurality of slidable elements 24 may be made of material that can be repeatedly subject to bending forces without fracturing required of a seaworthy watercraft of a predetermined size. Each fixed elements 22 may be tubular, forming an opening on each opposing end for slidably receiving one slidable element 24 through each opposing end. The plurality of fixed elements 22 may be connected, for example, by welding, along the length of the center hull portions 20, 148 at approximately evenly spaced increments.

Figure 5:
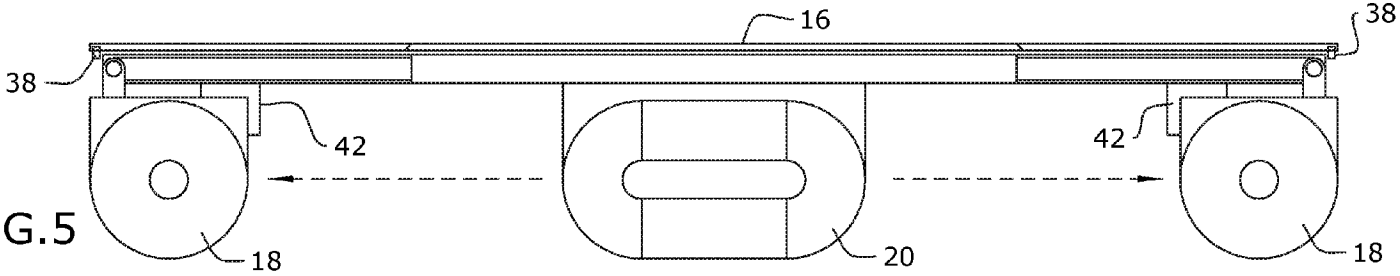
FIG. 5 is a front view of an exemplary embodiment of the present invention (omitting multiple components for illustrative clarity) illustrating the expanded configuration.
Figure 6:
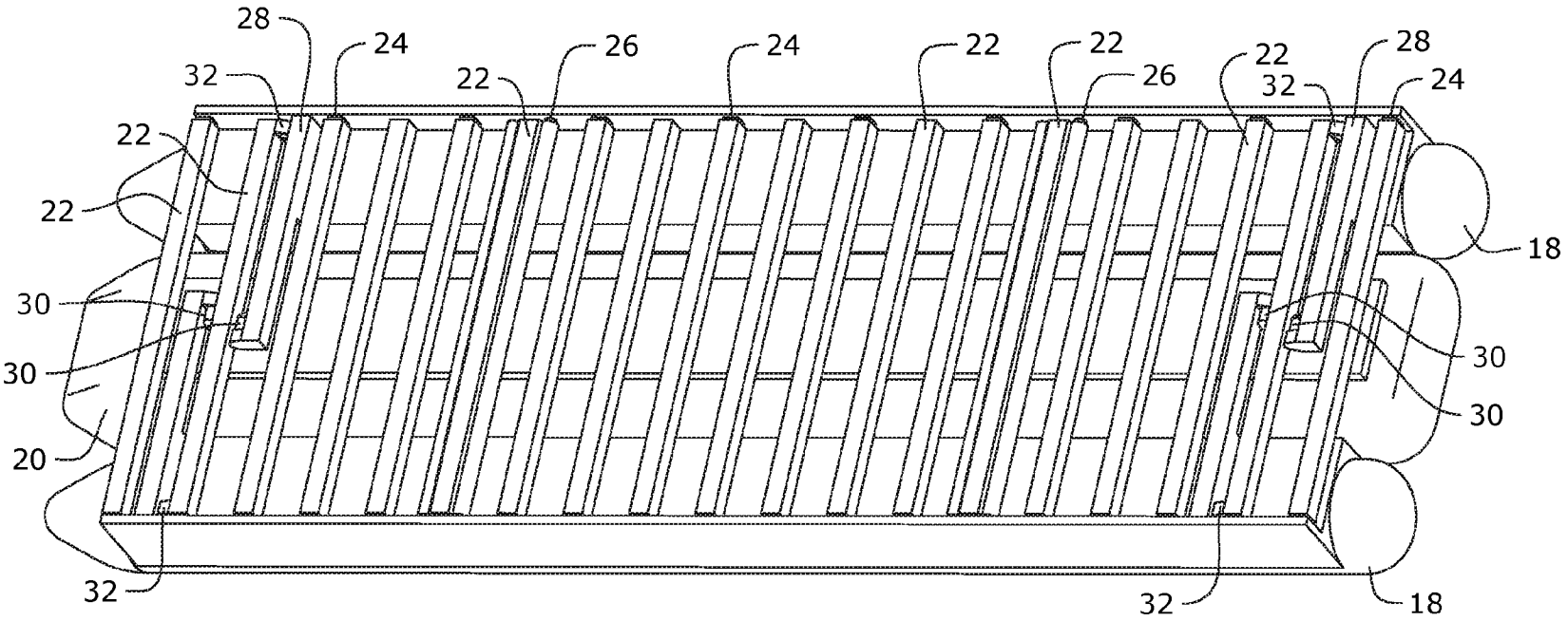
FIG. 6 is a top perspective view of an exemplary embodiment of the present invention (omitting multiple components for illustrative clarity) illustrating the contracted configuration.
Figure 7:
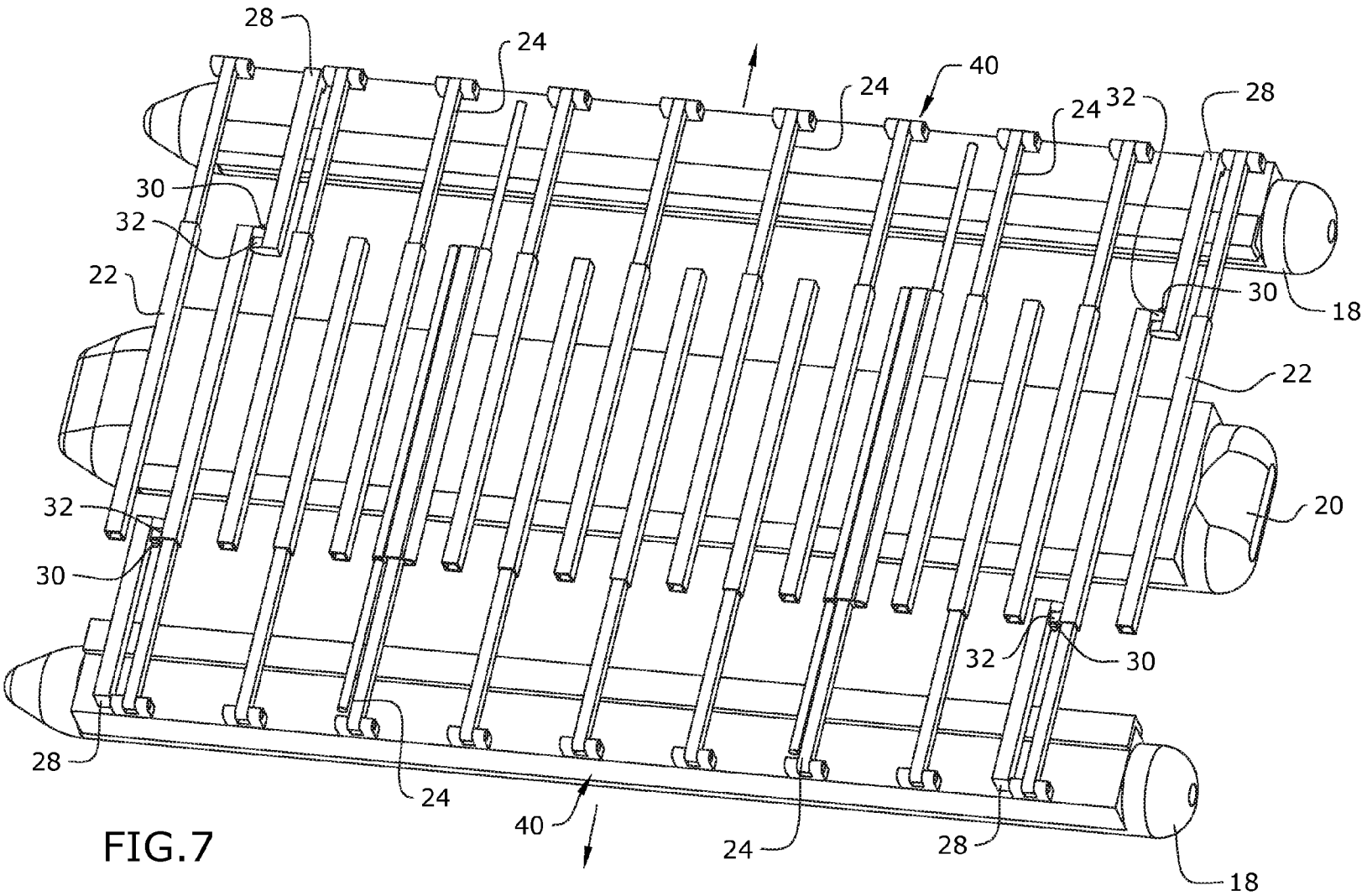
FIG. 7 is a top perspective view of an exemplary embodiment of the present invention (omitting multiple components for illustrative clarity) illustrating the expanded configuration.
Figure 8:
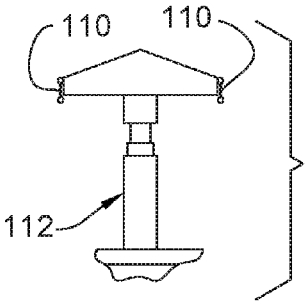
FIG. 8 is a front detail view of an exemplary embodiment an awning portion of the present invention, illustrating a closed configuration.
Figure 9:
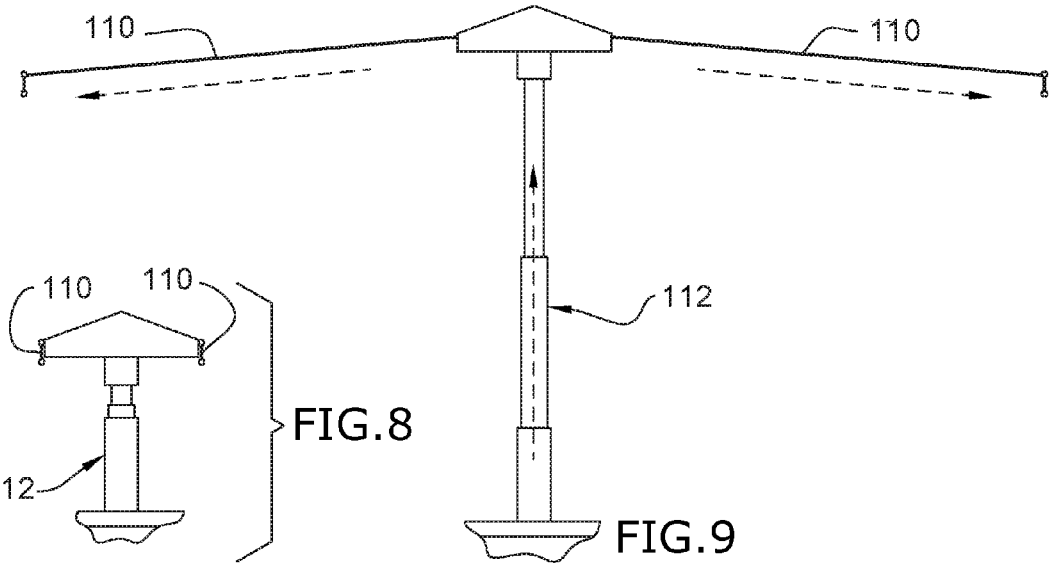
FIG. 9 is a front detail view of an exemplary embodiment the awning portion of the present invention, illustrating an open configuration.

Each of the plurality of slidable elements 24 may have a received end and a hinged end 48. Each hinged end 48 may be pivotably connected to a hull hinge 40. The plurality of hull hinges 40 may be connected along the length of both side hull portions 18, 144 padded edges 66, for example, by welding, at approximately evenly spaced increments. The plurality of hull hinges 40 may be adapted to restrict the extent of pivoting so as, for example, the two side hull portions 18, 144 are not allow to pivot more than forty-five degrees about a vertical axis. The two side hull portions 18, 144 pivoted zero degrees about the vertical axis is illustrated in FIG. 5. The plurality of hull hinges 40 may allow for expansion at any distance up to double the original width. For example, an eight-and-a half foot wide boat in the contracted position may extend to a seventeen foot boot, doubling the surface area, in the expanded configuration. It should be understood that the present invention may also enable a seven-and-a-half foot contracted position to extend to ten feet in the expanded positions.

The plurality of actuator arms 26 may be linear actuators, actuators and/or devices that create motion in a straight line so that the adjustable frame 44 may be extended from a contracted position to an expanded position. Each actuator arm 26 may be slidably received in an actuator sleeve 50. At least one actuator sleeve 50 may be connected to at least one fixed element 22. Each actuator arm 26 may include a fixed end and an extendable end 52. Each sleeve end may be slidably received within the actuator sleeve 50. Each extendable end 52 may be fixed to one of the two side hull portions 18, 144. The plurality of actuator arms 26 may be electric, pneumatic, hydraulic or the like. The plurality of actuator arms 26 may be independently remotely controlled from, for example, a deck control panel 36.

Figure 3:
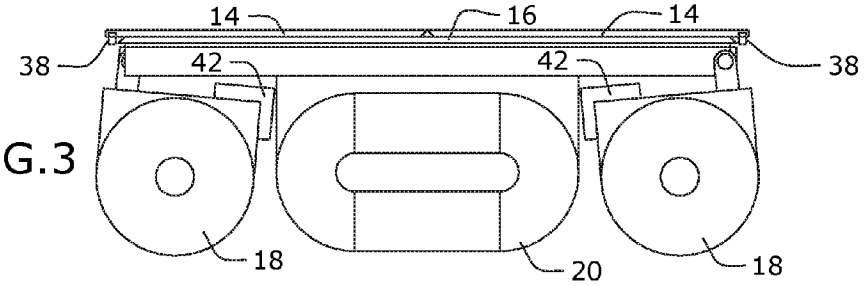
FIG. 3 is a front view of an exemplary embodiment of the present invention (omitting multiple components for illustrative clarity) illustrating the contracted configuration.
Figure 4:
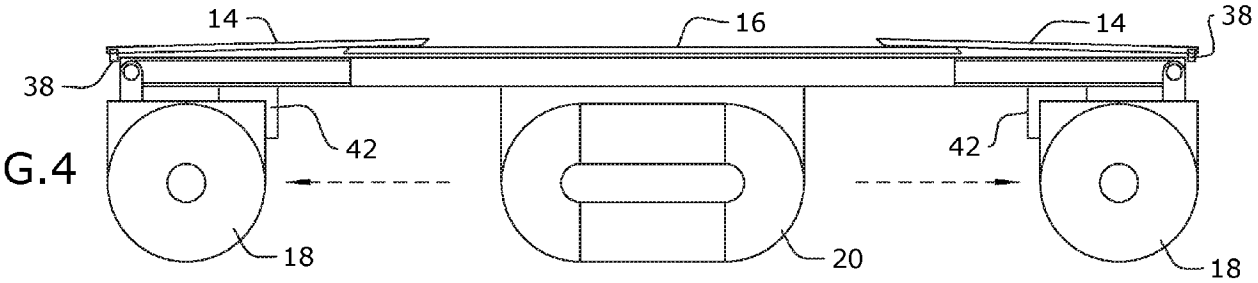
FIG. 4 is a front view of an exemplary embodiment of the present invention (omitting multiple components for illustrative clarity) illustrating a mid-expanded configuration.

In the contracted configuration, the size of the two side hull portions 18 and the center hull portions 20 may urge the two side hull portions 18 to pivot about the plurality of hull hinges 40, as illustrated in FIG. 3, so as to accommodate wider hull portions 18, 20 for a given fixed deck 16 width than would otherwise be allowed with non-pivoting hull hinges 40 connections to the two side hull portions 18.

The fixed deck 16 may be connected to the plurality of fixed elements 22. The fixed deck 16 width may terminate at two longitudinal mating edges 54. Each mobile deck 14 width may terminate at a longitudinal mating edge 56 and a longitudinal roller end 58. The two mobile decks 14 may approximately abut along their respective longitudinal mating edges 56 in the contracted position, supported by the fixed deck 16 on a higher plane thereof. Each of the two roller ends 58 may be pivotably connected to a plurality of spring loaded rollers 38. The plurality of spring loaded rollers 38 may be connected to the plurality of hull hinges 40. The plurality of spring loaded rollers 38 may by adapted so that the two mobile decks 14 in the contracted position may share the higher plane yet share a lower plane with the fixed deck 16 in the expanded position. The two mating edges 54 and the respective mating edges 56 may abut on the lower plane in the expanded position.

In certain embodiments, the extendable hull system 100 may include deck furniture 34, the deck control panel 36 and at least one telescopic awning support 12 connected thereto. The at least one telescopic awning support 12 may include a retractable awning 10 adapted to provide shade to substantially all deck furniture when the extendable hull system 100 may be in the expanded position.

The bracing system 46 may include a plurality of anti-roll braces 28, a plurality of anti-roll male members 30 and a plurality of anti-roll female members 32. Each female member 32 may be adapted to securely receive a complimentary male member 30 in a matingly engagement. When the plurality of male members 30 are matingly engaged with the plurality of female members 32 the bracing system 46 is adapted to resist the torque imposed about each mobile deck 14 by the buoyancy forces applied through each side pontoon 18. The bracing system 46 may be adapted to minimize the size of the decking 14, 16 so as to minimize the overall weight of the extendable hull system 100.

A pair of female members 32 may be connected to opposing port/starboard ends of a plurality of braced fixed elements 62, with one female member 32 on a bow side and the other female member 32 on a stern side thereof.

Each anti-roll braces 28 may be made of material that can be repeatedly subject to bending forces without fracturing required of a seaworthy watercraft of a predetermined size. Each anti-roll braces 28 may include a side end 60 and a locking end 64. Each side end 60 may be connected, for example by welding, to one of the two side hull portions 18, 144. Each locking end 64 may terminate in the male member 30.

A pair of anti-roll braces 28 may be placed so that one is disposed on the bow side and another is disposed on the stern side of the plurality of braced fixed elements 62. In the expanded position each male member 30 may be securely received by each female member 32 so as to prevent the two mobile decks 14 from extending past the expanded position.

In certain embodiments, the extendable hull system 100 may have only the two side hull portions 18, 144 and no center hull portions 20, 148. In such an embodiment, the plurality of elongated fixed elements 22 may be supported by the fixed deck 16. The fixed deck 16 may remain in a fixed position relative to the center line of the boat and/or extendable hull system 100 while the two side hull portions 18, 144 are extended and contracted.

In an alternate embodiment, the extendable hull system 100 may have a plurality of side hull portions 18, 144 and at least one center hull portions 20, 148 utilizing the plurality of actuator arms 60, the plurality of hull hinges 40 and the like, to move the plurality of side hull portions 18, 144 from the expanded configuration to the contracted configuration and back, while at least one fixed deck 16 remains fixed relative to the center line of the boat and/or extendable hull system 100.

A method of using the present invention may include the following. The extendable hull system 100 disclosed above may be provided. When being transported, the extendable hull system 100 may be in the contracted position to abide by state law and or for traffic safety considerations. When deployed as a watercraft, the extendable hull system 100 may be remotely extended from the contracted position to the expanded position when afloat so as to accommodate additional cargo and/or passengers.

In certain embodiments, the extendable hull system 100 may be adaptable for industrial/barge applications.

Referring to FIGS. 8 through 17, the present invention may include a extendable hull system 100 adapted to be configurable from a mono-hull to a multi-hull design, and able to be contracted back to the mono-hull design so as to take advantage of both types of hull designs depending on the boating conditions.

Figure 10:
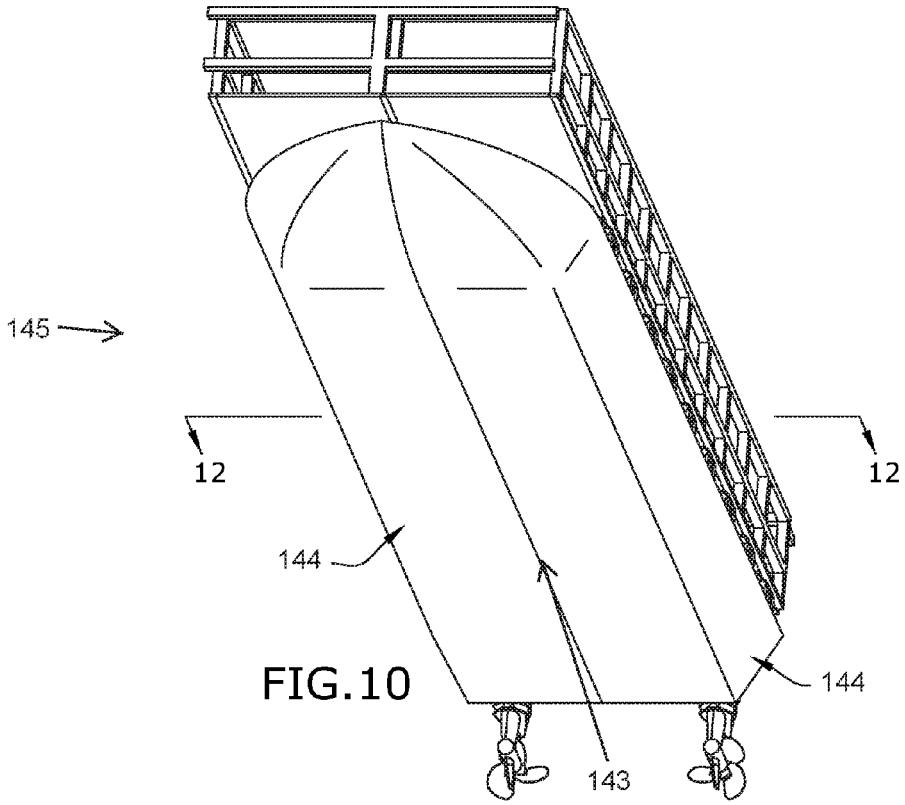
FIG. 10 is a detail bottom perspective view of an exemplary embodiment of the present invention, illustrating the contracted configuration.

FIG. 10 illustrates a mono-hull contracted configuration 145 of the present invention, whereby the mono-hull contracted configuration 145 offers the advantages of a mono-hull design, whereby two side hull portions 144 are dimensioned and adapted to abut each other along complementary abutment surfaces 147, forming a shared planing surface 143 at least near the transom. Each side hull portion 144 may be adapted to provide a planing surface 141 and cooperating abutment surfaces 147 for facilitating the shared planing surface 143 in the contracted configuration, as illustrated FIGS. 10-13. Moreover, each side hull portion 144 may form similar nesting cavities 151.

Figure 11:
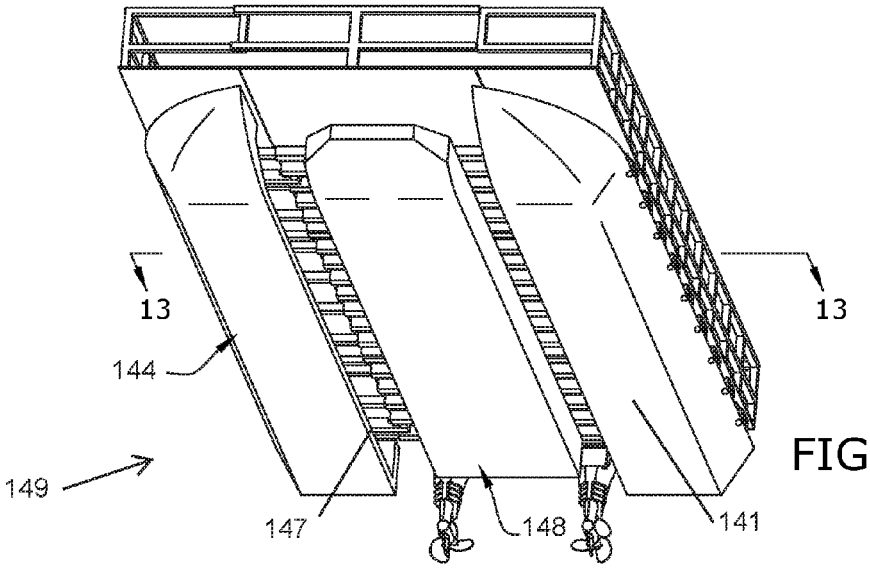
FIG. 11 is a detail bottom perspective view of an exemplary embodiment of the present invention, illustrating the expanded configuration.
Figure 12:
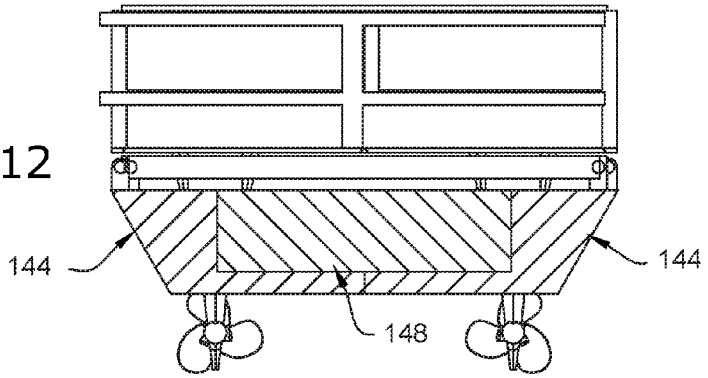
FIG. 12 is a section view of an exemplary embodiment of the present invention, taken along line 12-12 in FIG. 10.
Figure 13:
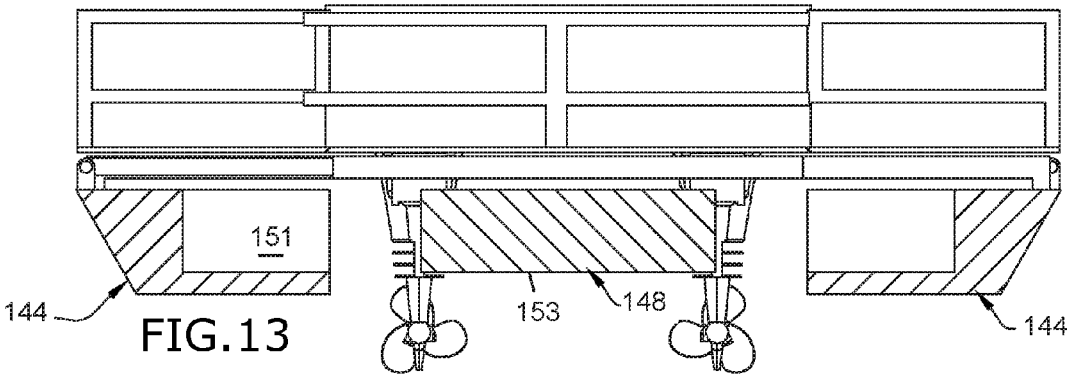
FIG. 13 is a section view of an exemplary embodiment of the present invention, taken along line 13-13 in FIG. 11.
Figure 14:
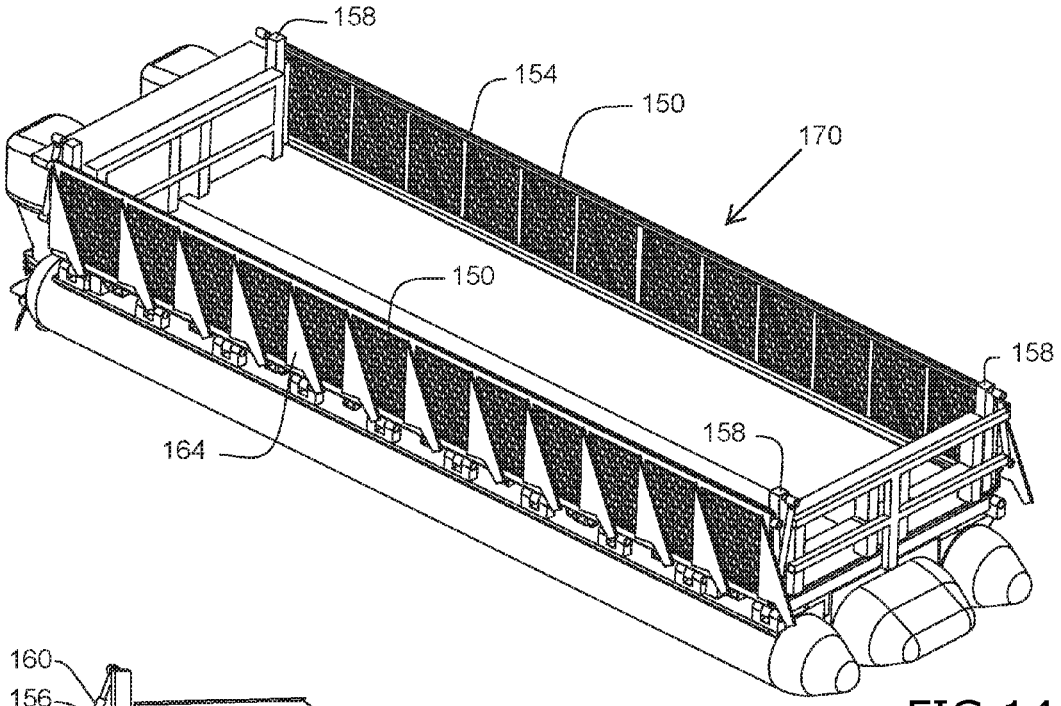
FIG. 14 is a perspective view of an exemplary embodiment of the present invention, illustrating a locked configuration.
Figure 15:
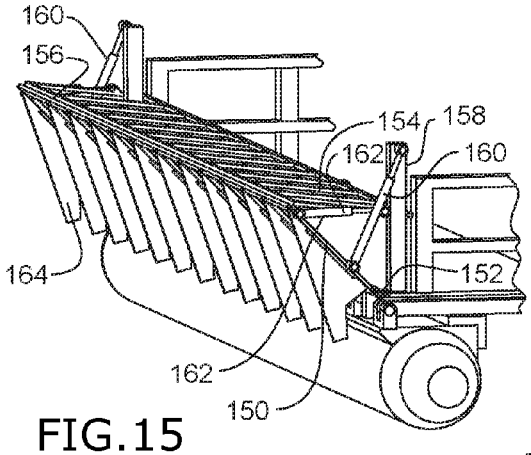
FIG. 15 is a detail perspective view of an exemplary embodiment of the present invention, illustrating a transitional configuration.
Figure 16:
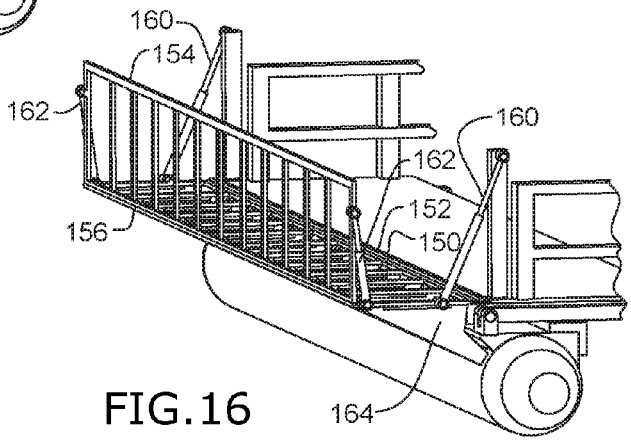
FIG. 16 is a detail perspective view of an exemplary embodiment of the present invention, illustrating a deployed configuration.
Figure 17:
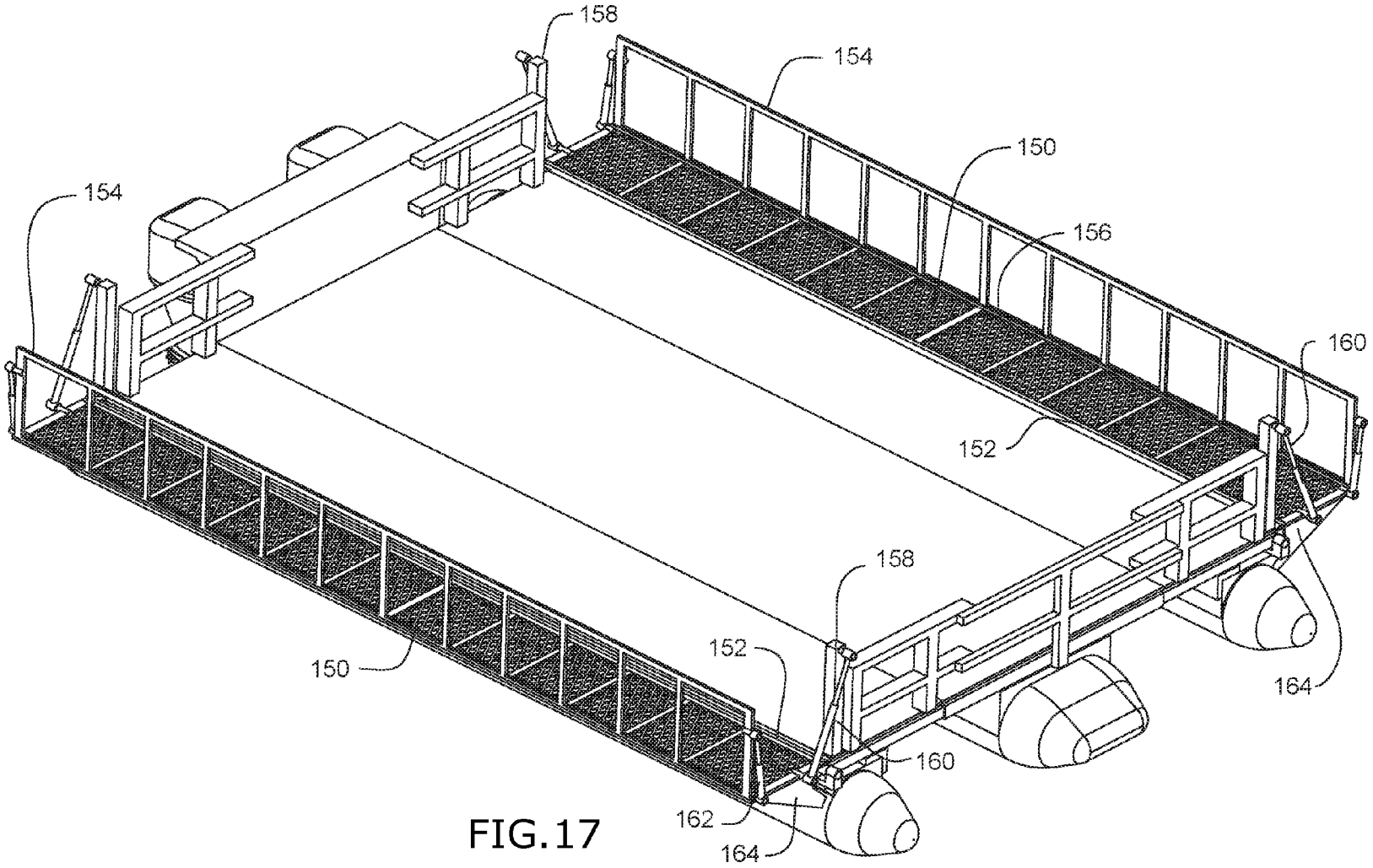
FIG. 17 is a perspective view of an exemplary embodiment of the present invention, illustrating the deployed configuration.

The present invention may also provide a center hull portion 148 dimensioned and adapted to nest within the cooperating nesting cavities 151 in the contracted configuration. The center hull portion 48 provides a center planing surface 153. The present invention is expandable into an expanded configuration 149, as illustrated in FIGS. 11 and 13. Moreover, the expanded configuration 149 enables a stepped hull configuration by recreating multiple running surfaces: the center surface 153 and the two opposing planing surfaces 141, as illustrated in FIG. 13. As the boat speed increases, the present invention in the expanded multi-hull configuration 149 may ride on these three running surfaces, 141, 153, 141, with area of contact with the water moving progressively further aft, resulting in more speed with less power.

The extendable hull system may provide two opposing bow and stern columns 112, wherein each column 112 may be vertically adjustable, such as telescopically. A retractable awning 110 may span both opposing columns 112 so that the awning 110 provides sufficient coverage for the decking 14 and 16 in the expanded configuration 149. The retractable awning 110 may be adjusted either remotely or manually so as to provide sufficient coverage of the decking in the mono-hull contracted configuration 145. Thus, in the open configuration, the retractable awning 110 may be dimensioned and adapted to selectively move between a contracted position and an expanded position, wherein the expanded position provides coverage in the expanded configuration 149, and wherein the contracted position provides coverage in the contracted configuration 145.

The extendable hull system may also provide a railing system 170 having a plurality of pivotally connected platform members 150 movable from a vertical locked configuration to a deployed configuration, thereby generally flush with the decking 16. Struts 160, 162 and the hull hinges 40, or alternatively platform hinges 152, may be adapted to provide the pivotal connection. Support brackets 164 may be disposed along the underside of at least some of the platform members 150, wherein the support brackets 164 fold down with gravity during the transitional configuration. Rail paneling 154 pivotally connected to the distal edge of at least some of the platform members 150 by rail hinges 156 may provide hand rail support in the deployed configuration.

It should be understood, of course, that the foregoing relates to exemplary embodiments of the invention and that modifications may be made without departing from the spirit and scope of the invention as set forth in the following claims.

What is claimed is:

1. An extendable hull system adapted to move between a mono-hull contracted configuration and a multi-hull configuration, comprising:

a center hull portion connected to a plurality of fixed frame elements;

two side hull portions, one of the two side hull portions disposed on the port and the starboard side of the center hull portion, respectively, wherein each side hull portion is connected to a plurality of slidable elements, each slidable element received by an associated complement fixed frame element of the plurality of fixed frame elements; and a plurality of actuator arms, each actuator arm extending from a fixed end to an extendable end, wherein each fixed end is connected to the plurality of fixed frame elements, and wherein each extendable end is connected to one of the two side hull portions so as to provide a mono-hull contracted configuration, wherein the two side hull portions abut in the mono-hull contracted configuration providing a shared planing surface.

2. The extendable hull system of claim 1, wherein the shared planing surface is disposed near a transom of the mono-hull contracted configuration.

3. The extendable hull system of claim 1, further comprising a complementary nesting cavity is provided in each of the two side hull portions.

4. The extendable hull system of claim 1, wherein the center hull portion is dimensioned and adapted to nest with the two nesting cavities is formed in the mono-hull contracted configuration.

5. The extendable hull system of claim 1, further comprising a complementary abutment surface is provided along each of the two side hull portions, wherein the two abutment surfaces abut in the mono-hull contracted configuration.

6. The extendable hull system of claim 1, further comprising a center planing surface provided by the center hull.

7. The extendable hull system of claim 6, wherein the multi-hull configuration provides a stepped hull configuration comprising the center planing surface and a side planing surface of each of the two side hull portions.

8. The extendable hull system of claim 1, further comprising a retractable awning dimensioned and adapted to selectively move between a contracted position and an expanded position, wherein the expanded position provides coverage in the expanded configuration.

9. The extendable hull system of claim 8, further comprising two telescopically adjustable columns between which the retractable awning spans.

10. The extendable hull system of claim 1, further comprising a railing system pivotably connected to at least one of the two side hull portions so as to be movable between a vertical configuration orthogonal to the plurality of slidable elements and a deployed configuration parallel and adjacent to the plurality of slidable elements associated with the at least one of the two side hull portions.

* * * * *